US007270356B2

(12) United States Patent
Roderick

(10) Patent No.: US 7,270,356 B2
(45) Date of Patent: Sep. 18, 2007

(54) HANGER HOISTER TOOL

(76) Inventor: Brett Ashley Roderick, 10649 Assateague Rd., Berlin, MD (US) 21811

( * ) Notice: Subject to any disclaimer, the term of this patent is extended or adjusted under 35 U.S.C. 154(b) by 0 days.

(21) Appl. No.: 10/810,409

(22) Filed: Mar. 26, 2004

(65) Prior Publication Data

US 2005/0212314 A1 Sep. 29, 2005

(51) Int. Cl.
*A47F 13/06* (2006.01)

(52) U.S. Cl. ..... 294/19.1; 294/24

(58) Field of Classification Search ..... 294/22, 294/23, 24, 92, 57, 50, 123, 904, 120, 19.1; 16/420; 269/3, 6, 41; 81/44
See application file for complete search history.

(56) References Cited

U.S. PATENT DOCUMENTS

| | | | | | |
|---|---|---|---|---|---|
| 202,540 | A * | 4/1878 | Grosjean | 294/57 |
| 761,136 | A * | 5/1904 | Beck | 294/22 |
| 2,197,278 | A * | 4/1940 | Sverdahl | 33/501 |
| 2,544,492 | A * | 3/1951 | Downing | 227/181.1 |
| 2,718,374 | A * | 9/1955 | Kellenbarger | 254/17 |
| 3,049,337 | A * | 8/1962 | Griggs | 254/131 |
| 3,452,963 | A * | 7/1969 | Holst, Sr. et al. | 254/131 |
| 4,181,295 | A * | 1/1980 | Duffy | 269/3 |
| 4,264,063 | A | 4/1981 | Halula | |
| 4,947,616 | A | 8/1990 | Sorton | |
| 5,054,755 | A | 10/1991 | Hawkes | |
| D336,231 | S * | 6/1993 | Strom | D8/89 |
| 5,312,095 | A | 5/1994 | Rennie | |
| 5,383,320 | A * | 1/1995 | Sorton | 52/749.1 |
| 6,126,156 | A * | 10/2000 | Brodeur | 269/41 |
| 6,272,951 | B1 * | 8/2001 | Lambson | 81/44 |

* cited by examiner

*Primary Examiner*—Patrick Mackey
*Assistant Examiner*—Esther O Okezie
(74) *Attorney, Agent, or Firm*—John C. Andrade, Esq.; Parkowski, Guerke & Swayze, P.A.

(57) ABSTRACT

The present invention is a hanger hoister tool for placing a bracket to secure a joist to a header. The tool has legs extending upward and a handle extending downward and outward. The tool also has a pedestal keel extending outward for holding the bracket when inserted between the legs and a pedestal tongue extending outward in the opposite direction. The pedestal keel and the pedestal tongue are offset to accommodate the width of the heel of the bracket. The tool is designed to place the bracket either before or after the joist is secured to the header and is economical and made of lightweight plastic.

6 Claims, 4 Drawing Sheets

HANGER HOISTER TOOL

BACKGROUND OF THE INVENTION

1. Field of the Invention

This invention is a tool designated to introduce safety and speed in accurately placing a joist hanger into a proper position to be secured. This invention works both before and after the joist itself is secured.

2. Description of the Prior Art

Joist hangers are a necessary part of construction in which a metal bracket is used to secure dimensional wood to a header or ledger often at 90 degrees to the dimensional board and various angles in between. The desire for a tool that can speed up the process of installation while being accurate and safe for the user has existed since hanger use was required. There have been several joist hanger tools invented to try and achieve this in the past. These prior art devices have achieved some of their intended goals but most fail in the safety or productivity area. All, however, fail in the area of being a useful tool before and after the joist has been installed. Often due to increased labor forces it is not productive to install joist hangers before installing joists. Often decks and floors are production framed which requires joist hangers to be installed after the fact. Another problem occurs when lumber is not dimensional; i.e. 2"×12" is 11-½" on one end and 11-¼" on the other, which is often the case. This requires the joist to be installed first and hangers to be installed after the fact to get the same level at the top of the joists in order to receive flooring or decking boards. If a deck needs to be built and the supply center has run out of those needed hangers, paying a crew of workers to stand around and wait on someone to find hangers is not cost effective.

U.S. Pat. No. 4,947,616 positions a joist hanger using the top edge of a header. This device uses magnets to hold the sides of the hanger at their proper width and needs to be adjusted to use. The 616 device also requires the user to provide hand pressure close to the area to be nailed and is therefore unsafe and cannot be used after the joist is placed.

U.S. Pat. No. 5,054,755 uses a spring biased projection in its hand tool for mounting joist hangers and as designed is incapable of exactly flushing out both top of the header and joist as the joist hanger thickness was not taken into account during design. This device does not remove the user's hand from the immediate vicinity of the nail gun. It does not maintain the sides of the hanger and cannot be used after the joist has been secured.

U.S. Pat. No. 6,126,156 discloses a tool for supporting a joist hanger during application of the hanger to the joist. The tool will need to be tilted back and forth to accommodate various heights in hangers and this tilt will potentially cause a poorly adjusted height. The tool cannot be used after the joist is attached.

It is an object of the present invention to have a tool that's effective both before and after the joist has been secured. Other objects of this invention are to provide a safe distance between a nail gun or hammer and the hand using the tool; maintain visibility of layout marks; be affordable; minimize labor cost on joist hanger installation and improve productivity; be able to fit into a carpenter's pouch, on a nail and in a hammer holder; made from plastic to eliminate extra weight on a carpenter's pouch; and repeated accuracy and uniformity.

SUMMARY OF THE INVENTION

The hanger hoister tool of the present invention for placing a bracket to secure a joist to a header includes a tool body, legs, rigidly connected to the body and extending upward from the body, a handle extending downward from the body and a means for holding a "U" shaped joist hanger or bracket having a heel and two upright members when inserted between the legs. The handle preferably extends downward and outward at an angle from the body and preferably is ribbed for better gripping of the handle. The means for holding the bracket when inserted between the legs is preferably a pedestal keel extending outward from the body. Also extending outward from the body in the opposite direction of the pedestal keel away from the body is preferably pedestal tongues. Wherein the top of the pedestal keel and the top of the pedestal tongues are offset such that the top of the pedestal keel is lower than the top of the pedestal tongues by the thickness of the heel portion of the bracket. The hanger hoister tool is preferably constructed of plastic which is lightweight and economical.

To use the hanger hoister tool of the present invention, hold the handle of the tool with one hand and load hanger into hanger tool by sliding hanger between the vertical legs with the hanger resting against the header side of the tool. Slide until the bottom of the hanger is nested with the pedestal keel and the nailing face of the hanger is tight to the header. Place hanger firmly to header, using layout marks, the tool should be held into the header and then lifted up to snug the joist hanger to the bottom of the joist. When the inside of the hanger lines up with the layout marks, use a nail gun to place one nail in each side of the hanger. Remove the tool and finish nailing. If a nail gun is not present you can align the hanger and hit the prongs on each side of the hanger with a hammer, remove the tool and finish nailing by hand.

If the joists are already installed but no hangers were used, this tool will still work using the above procedure.

DESCRIPTION OF THE PREFERRED EMBODIMENT

Figure 1:
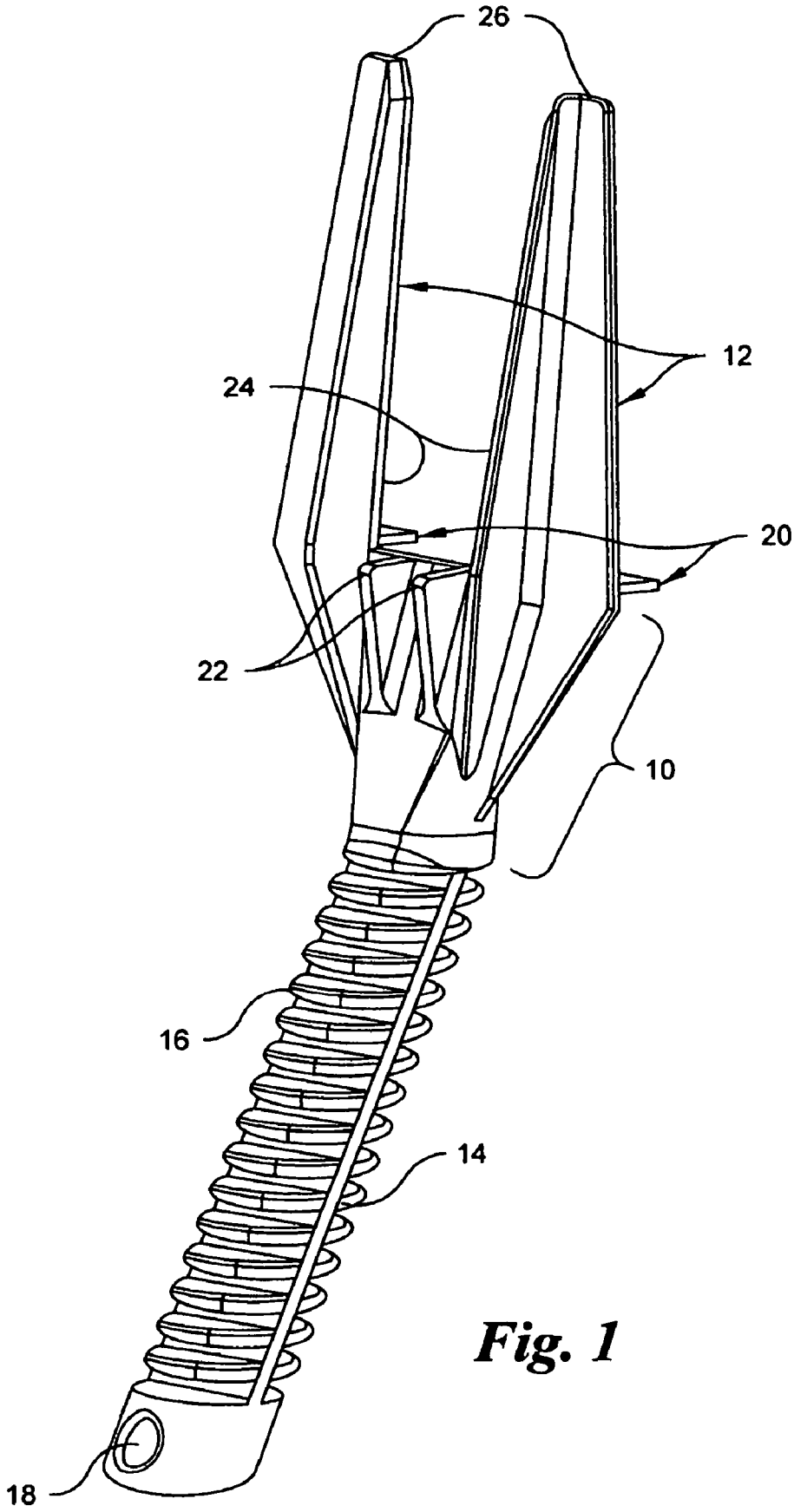
FIG. 1 is a perspective view of the Hanger Hoister Tool.
Figure 2:
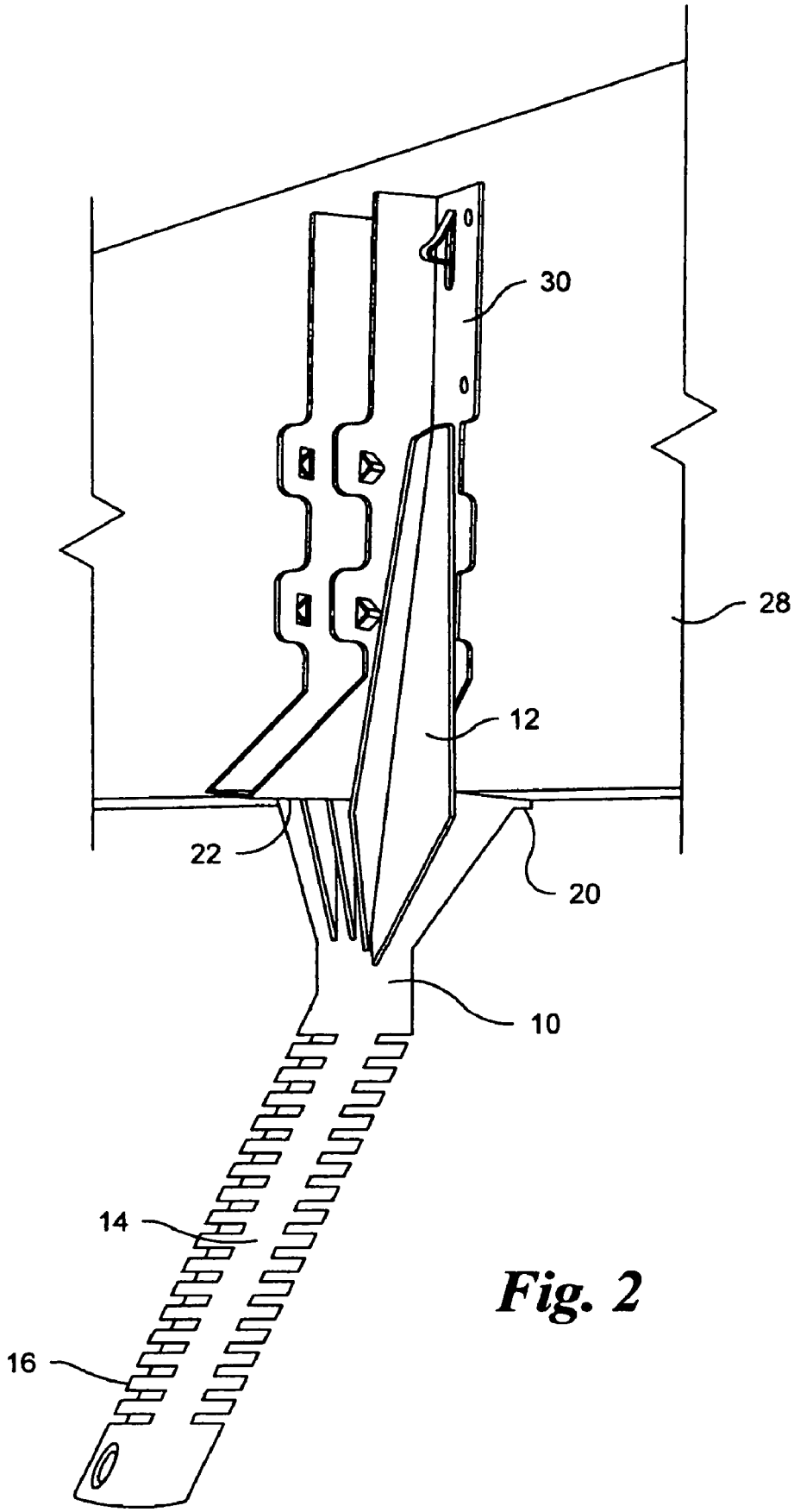
FIG. 2 is a perspective view of the Hanger Hoister Tool being used to properly place a joist support bracket before the joist is attached.

The Hanger Hoister Tool is shown in FIG. 1. The body 10 of the tool is shown with the legs 12 rigidly connected to the body 10 and extending upward from the body 10. The legs as shown have a bracket side 24 and a header side 26. The pedestal keel 22 is shown extending outward back from the body 10 and as shown forms the base for holding a bracket when inserted between the legs 12. The pedestal tongues 20 extend outward in the opposite direction from the body 10 and are a means for squaring or positioning the tool under a header. The handle 14 extends downward and outward from the body 10. The handle preferably has ribs 16 that help to grip the tool and a utility aperture 18 is shown in the handle for hanging the tool. The handle is shown extending at an angle backward from the body to give enough room for someone holding the tool space to fit their hand around the tool and still utilize the tool. The Hanger Hoister Tool is shown in use in FIG. 2. The bracket or joist support 30 is shown fitting snugly between the vertical legs 12. The vertical legs should extend at least 2 inches and preferably about 4 inches from the body 10 as shown and the extension is necessary to keep the bracket from opening wider. At this point the joist or beam is not attached and the bracket can easily be nailed to the header 28. The pedestal tongues are offset approximately 0.0625 inches from the pedestal keel and they are only necessary if the joist supporter bracket is applied pre-joist or prior to the time that the beam or joist is attached to the header.

Figure 3:
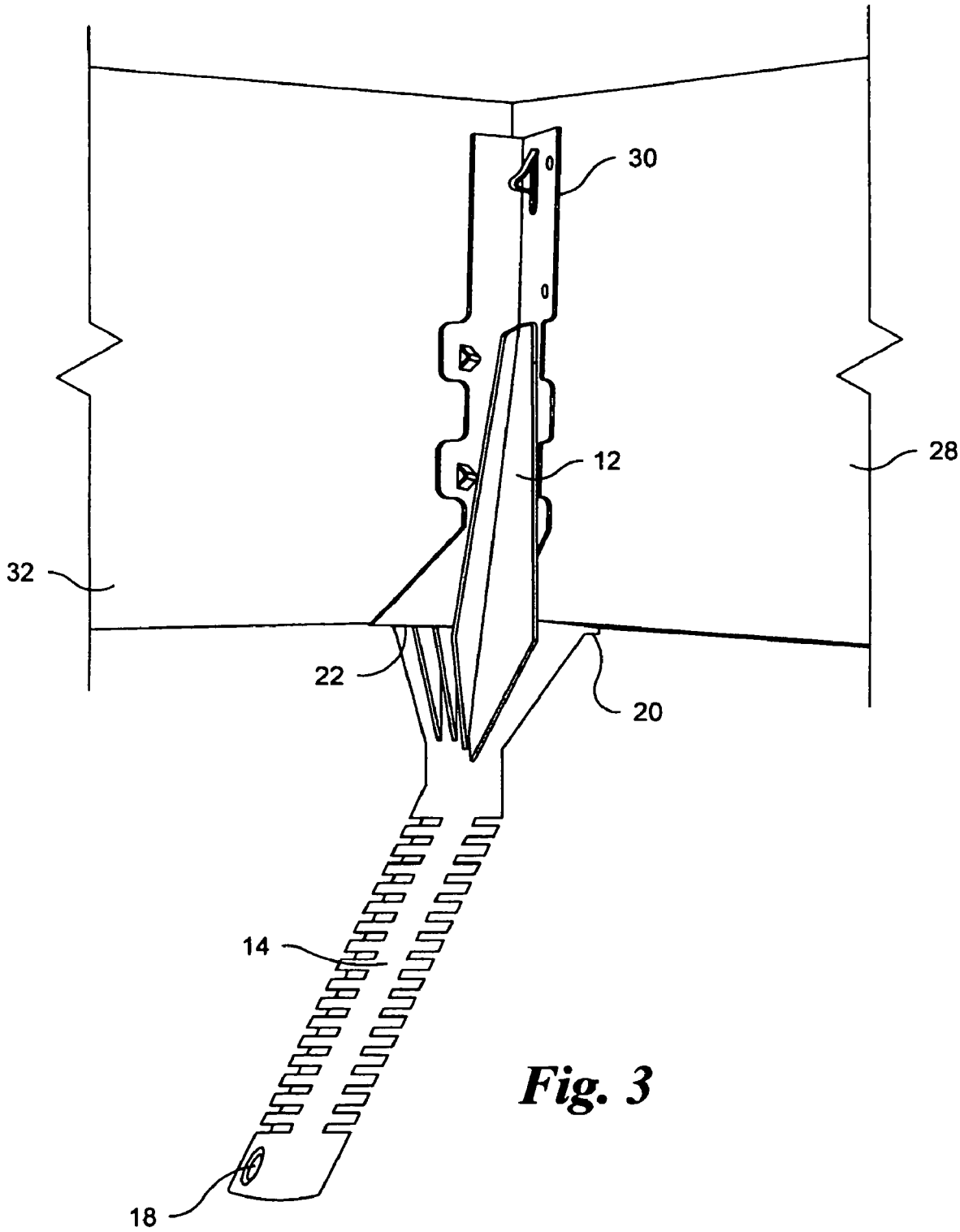
FIG. 3 is a perspective view of the Hanger Hoister Tool being used to install a joist support bracket.

FIG. 3 shows a Hanger Hoister being used to install the bracket 30 where a joist 32 is being placed and attached perpendicular to the header 28.

Figure 4:
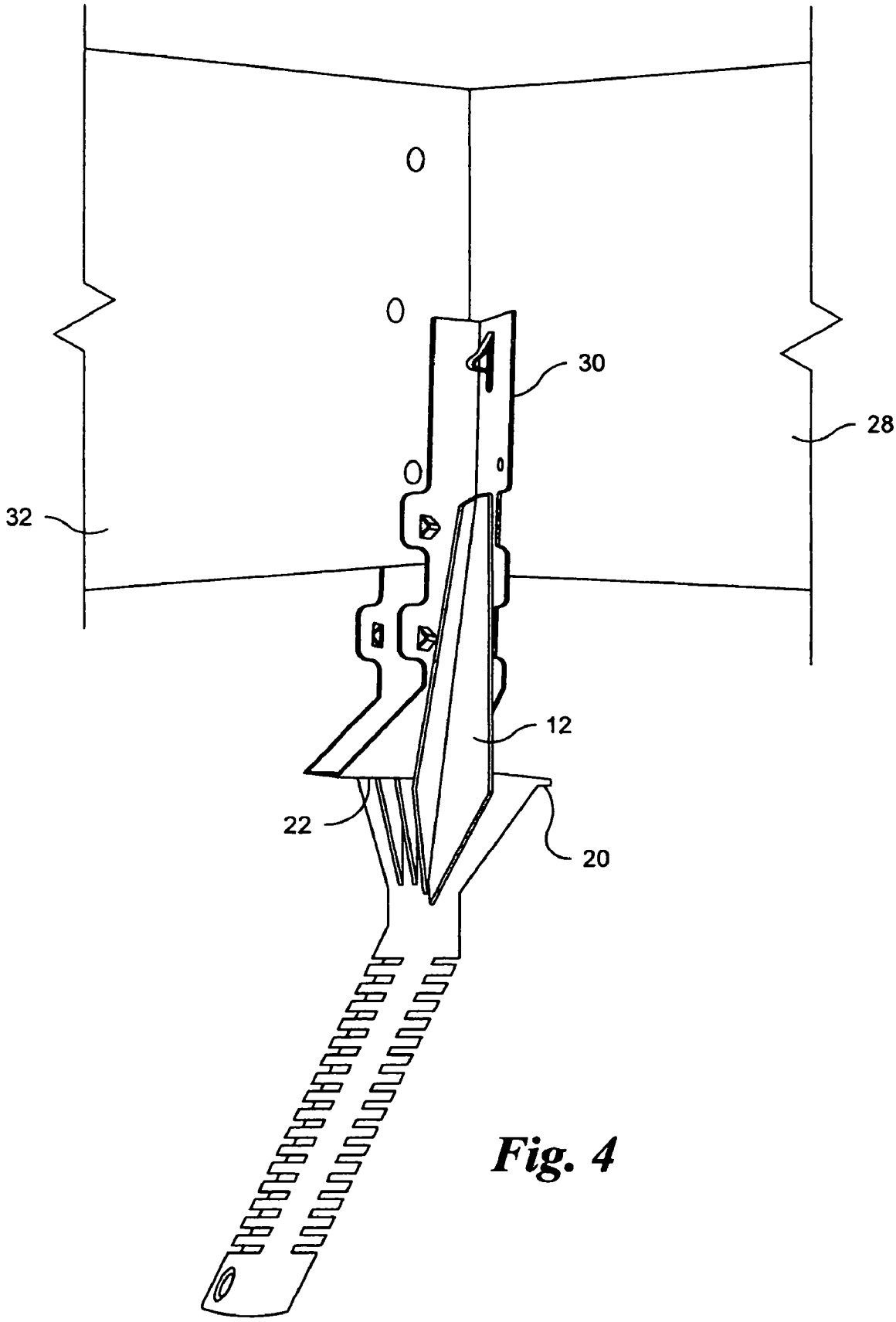
FIG. 4 is a perspective view of the Hanger Hoister Tool attaching a joist support bracket to a previously attached joist.

FIG. 4 shows the bracket or joist support being applied on a previously attached joist 32. The bracket 30 is shown held by the pedestal keel 22. Even though the pedestal tongues 20 would stop the Hanger Hoist Tool when it reaches the header 28, when the portion of the bracket sitting on top of the pedestal keel 22 reaches the bottom of the joist 32 it would also stop and thus for the previously attached joist the pedestal tongues would not be necessary.

I claim:

1. A Hanger Hoister Tool for placing a bracket to secure a joist to a header comprising:

(a) a tool body;

(b) legs rigidly connected to said body and extending upward from said body;

(c) means for supporting a bracket having a heel and two upright members when inserted between said legs comprising a pedestal keel forming a base for said bracket to nest on extending outward from said body; and (d) a handle extending downward from said body; and (e) pedestal tongues extending outward in the opposite direction of the pedestal keel away from said body.

2. The Hanger Hoister Tool of claim 1 wherein said pedestal keel and said pedestal tongues have a top and said top of said pedestal keel is offset and lower than said top of said pedestal tongue by the thickness of said heel of said bracket, wherein said handle has a thickness of one-sixteenth of an inch.

3. The Hanger Hoister Tool of claim 1 wherein the tool is constructed of plastic.

4. The Hanger Hoister Tool of claim 1 further comprises a utility aperture located within said handle.

5. The Hanger Hoister Tool of claim 1 where said handle extends downward and outward at an angle from said body.

6. The Hanger Hoister Tool of claim 5 wherein the handle is ribbed.

* * * * *